United States Patent [19]

Dudley et al.

[11] Patent Number: 5,052,186

[45] Date of Patent: Oct. 1, 1991

[54] CONTROL OF OUTDOOR AIR SOURCE WATER HEATING USING VARIABLE-SPEED HEAT PUMP

[75] Inventors: Kevin F. Dudley, Cazanovia; Lowell E. Paige, Pennellville; Kevin B. Dunshee, Syracuse; Roger J. Voorhis, Pennellville, all of N.Y.

[73] Assignee: Electric Power Research Institute, Inc., Palo Alto, Calif.

[21] Appl. No.: 586,004

[22] Filed: Sep. 21, 1990

[51] Int. Cl.[5] ..... F25B 7/00; F25B 1/00

[52] U.S. Cl. ..... 62/79; 62/215; 62/228.4

[58] Field of Search ..... 62/228.4, 238.6, 180, 62/215, 238.7, 79

[56] References Cited

U.S. PATENT DOCUMENTS

| | | | |
|---|---|---|---|
| 4,420,947 | 12/1983 | Yoshino | 62/228.4 X |
| 4,856,578 | 8/1989 | McCahill | 165/29 |
| 4,893,476 | 1/1990 | Bos et al. | 62/79 |

*Primary Examiner*—William E. Wayner
*Attorney, Agent, or Firm*—Wall and Roehrig

[57] ABSTRACT

An integrated heat pump and hot water system of the type having a variable speed compressor is controlled during a water heating mode, in which outdoor air serves as the heat source. The controlling is carried out on the basis of a field of outside temperature and water temperature. The compressor speed is controlled based on the outdoor air temperature, and the compressor is run at a maximum speed between a minimum outdoor temperature and a low temperature somewhat above the minimum, at minimum speed for outdoor air temperature between a maximum temperature and a high temperature below the maximum temperature, and at a speed that depends linearly on outdoor temperature for intermediate outdoor temperatures. There is a permissible temperature field or envelope bounded by the minimum and maximum outdoor temperatures, by minimum and maximum water temperatures, and by an efficiency floor and a torque limit ceiling.

8 Claims, 2 Drawing Sheets

WATER HEATER
USER SETPOINT
19
CONTROLLER
18
WATER HEAT RELAY
16
VAR. SPEED COMPRESSOR
PUMP
OUTDOOR FAN
23
22
22
21
24
T
TO
OUTDOOR AIR TEMPERATURE SENSOR
X
20
WATER HEAT EXCHANGER
14
P
S
P
11
12
10
WATER TEMPERATURE SENSOR
T
17
TW
WATER HEATER TANK
15
13

CONTROL OF OUTDOOR AIR SOURCE WATER HEATING USING VARIABLE-SPEED HEAT PUMP

BACKGROUND OF THE INVENTION

This invention is directed to commercial or residential integrated heat pump systems that provide water heating, and which can also provide heating or cooling of a comfort zone, as required. The invention is more particularly directed towards an improved control method for delivering water heating from a variable speed heat pump system using outdoor air as the heat source while balancing user comfort and efficiency.

Integrated heat pumps are often employed to provide heating or cooling, as needed, to a residential or commercial comfort zone, i.e., the interior of a residence, office complex, hospital, or the like. Integrated heat pumps are also employed to heat water. A heat pump system for air conditioning, comfort zone heating, and water heating is described in U.S. Pat. No. 4,766,734. Systems of this type can have several modes of operation, such as air conditioning alone, comfort zone space heating alone, water heating alone, air conditioning with water heating, and comfort zone space heating with water heating. Additional modes, such as a defrost cycle, can also be employed. For comfort zone heating and supplemental water heating, resistive elements are employed as auxiliary heating elements for use at times when the heat pump alone cannot produce sufficient heating of the comfort zone or produce enough hot water in the water heater.

For efficient operation, the speed of the variable speed compressor for the heat pump should be controlled in dependence on the outdoor temperature, and on the relation of water temperature to outdoor temperature, as these factors are directly related to the heat load imposed on the heat pump. Moreover, the heat pump should be used only where it is a more efficient heating means then other sources of water heating, and should have its operating conditions limited to safe zones of operation. The heat pump compressor should be controlled to operate only in condition where the motor torque is below a safe limit to torque ceiling. However, no previously proposed heat pump systems have incorporated any means to ensure efficiency and safe operation in this regard.

OBJECTS AND SUMMARY OF THE INVENTION

It is an object of the present invention to improve integrated heat pump systems, to include features not provided in the prior art.

It is a further object of the present invention to provide a method of operating an integrated heat pump and hot water system that controls compressor operation for water heating so that the compressor and heat pump are used only when the heat pump is the most efficient means for heating water and only when the heat pump can be operated within safe torque load limits.

It is a yet further object to provide straightforward and effective means to ensure safe and efficient operation of the compressor for heat pump water heating.

In accordance with one aspect of this invention, these and other objects are attained in an integrated heat pump and hot water system that is capable of providing heating or cooling to a commercial or residential comfort space. The heat pump and water heating system has a variable speed compressor with a suction or intake port and a pressure or discharge port. Compressed refrigerant fluid from the discharge port passes into a water heat exchanger to heat water for the hot water portion of the system by transfer of heat from the compressed fluid. An outdoor heat exchanger has a heat exchanger coil that is coupled to the water heat exchanger and the suction port of the compressor. The refrigerant fluid passing through the coil draws heat from the outside air and this heat is transferred to the water in the water heat exchanger. A controller associated with the heat pump and hot water system has an output channel to control the speed of the variable speed compressor and has inputs connected respectively to a water heater setpoint adjustment device, an outdoor air temperature sensor, and a water temperature sensor. The compressor is controlled and operated in accordance with the outdoor temperature $T_O$ and the water temperature $T_W$.

The controller controls the speed of the compressor to operate at a higher speed when the outdoor temperature is $T_O$ is low, within a range of outdoor temperatures from a minimum temperature to a maximum temperature, for example from 17 degrees F. to 95 degrees F., depending on the compressor and the refrigerant fluid used. The compressor speed is controlled at a minimum speed for outdoor temperatures between the maximum temperature and a high temperature below the maximum temperature; for example 67 degrees F. The compressor is likewise operated at maximum speed for outdoor temperatures between the minimum temperature and a predetermined low temperature above that minimum outdoor temperature, for example 47 degrees F. For outdoor temperatures between 47 and 67 degrees F. the compressor speed rises with a decrease in outdoor temperature.

In order to effect safe and efficient operation the compressor operation is limited to a field of temperatures between the minimum and maximum outdoor temperatures, for the temperature $T_O$ and between a minimum and a maximum water temperature for the temperature $T_W$. The minimum temperature $T_W$ can be some water temperature above the freezing point, e.g. 40 degrees F., while the maximum temperature $T_W$ can be the temperature established on the setpoint adjustment device, which is limited to a predetermined maximum temperature reached at the maximum allowable compressor discharge pressure.

The field of permissible operating temperatures ($T_O$, $T_W$) is also limited, for corresponding outdoor temperatures $T_O$, to water temperatures $T_W$ at or below temperatures $T_E$ calculated from a compressor efficiency floor relationship in which the temperatures $T_E$ increase with increasing outdoor temperatures $T_O$ for at least some outdoor temperatures above the minimum outdoor temperature. The permissible operating temperature field is also limited, for corresponding outdoor temperatures $T_O$, to water temperatures $T_W$ at or below temperatures $T_T$ calculated from a compressor torque ceiling relation in which the torque ceiling temperatures $T_T$ decrease with increasing outdoor temperatures for at least some temperatures below the maximum outdoor temperature. In a practical embodiment the efficiency floor temperature outdoor relation and the torque ceiling relation are treated as linear functions of the outdoor temperature $T_O$. In effect the field of temperatures ($T_O$, $T_W$) within which the compressor is run is graphed as a six-sided figure or performance envelope. Top and bottom sides are defined by the maximum and minimum values of water temperature $T_w$. Left and right sides are defined by the minimum and maximum outdoor temperatures $T_o$. An efficiency floor sloping edge joins the left side to the upper side of the performance envelope, and a torque ceiling sloping edge joins the upper edge to the right edge of the performance envelope.

For a given heat pump and hot water system, compressor operation is governed using only the measurements taken by the water temperature sensor and outdoor air temperature sensor. Torque and efficiency are controlled without requiring direct measurement of motor torque, current load, or refrigerant pressure.

The above and many other objects, features, and advantages of this invention will become apparent to those skilled in the art from a perusal of the ensuing detailed description of a preferred embodiment, to be read in conjunction with the accompanying Drawing.

DETAILED DESCRIPTION OF A PREFERRED EMBODIMENT

Figure 1:
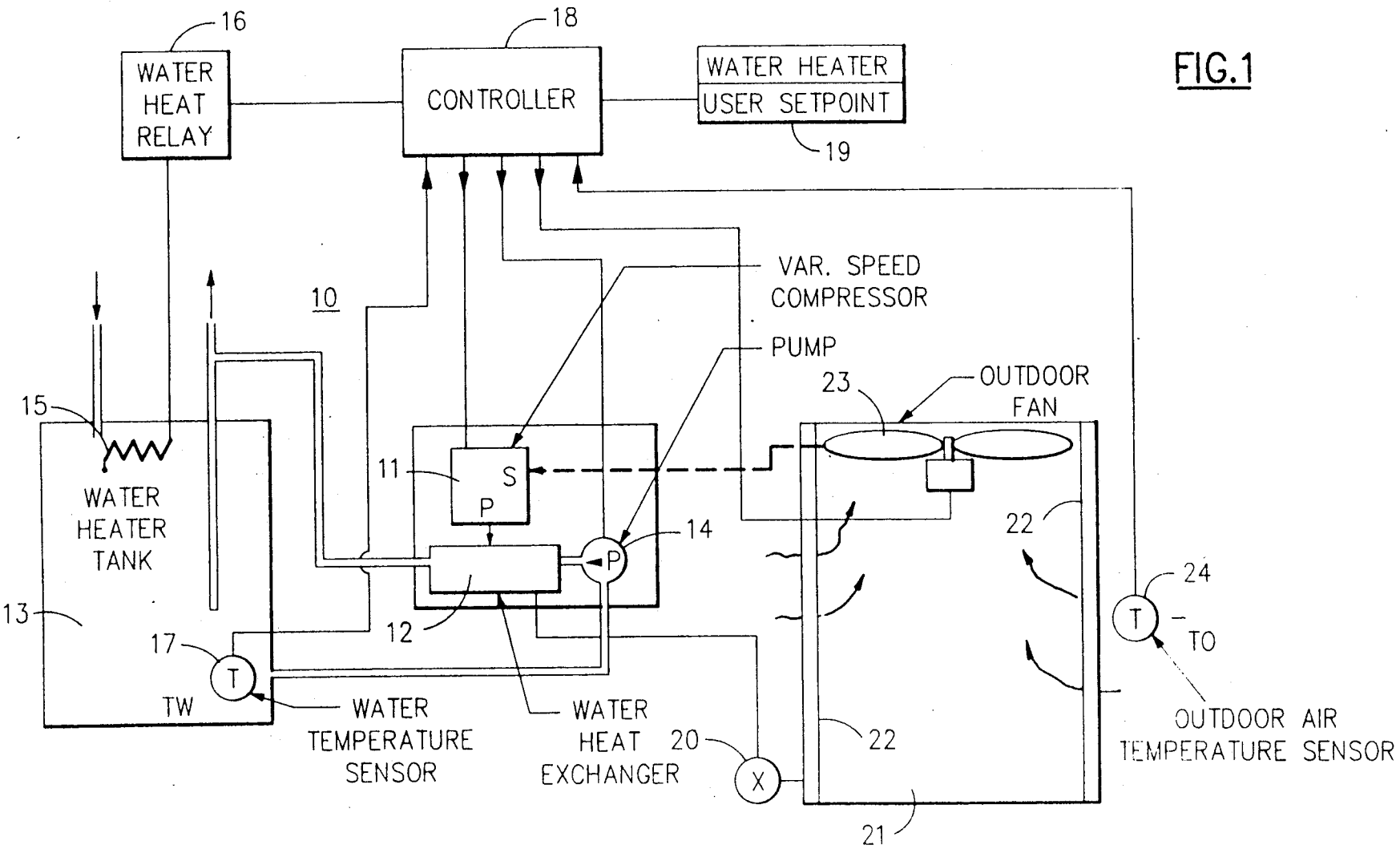
FIG. 1 is a diagrammatic representation of an integrated heat pump and hot water system that embodies the principles of this invention.

With reference to the Drawing, and initially to FIG. 1, there is shown an integrated heat pump and hot water system 10 which is generally of known design. The system has a variable speed compressor 11 capable of pumping a refrigerant fluid received at low pressure at a suction or intake port S and discharged at high pressure from a discharge port P. The compressed fluid passes to a water heat exchanger 12 where the refrigerant fluid gives up its heat to water that is stored in a hot water tank 13 and is pumped between the tank 13 and the heat exchanger 12 by a water pump 14. A resistive heating element 15 that is powered through a water heater relay 16 provides supplemental or emergency heat to the water, and also heats the water under conditions where the compressor 11 would not heat the water as efficiently as the resistive element 15, or where the torque on the compressor 11 may be above a safe limit. A temperature sensor 17 disposed in the water tank 13 is connected to a system controller 18 and provides the same with a temperature input representing the water temperature $T_w$ of the water in the tank 13. The controller 18 also has outputs connected to the compressor 11 to control its speed, to the water pump 14 and to the water heater relay 16. A setpoint adjustment element 19 also connected to the controller 18 sets a programed water temperature to establish a maximum water temperature $T_w$.

After leaving the water heat exchanger 12, the refrigerant fluid passes through appropriate valving and conduit to an expansion valve 20 and thence to an outdoor heat exchanger 21 in which a coil 22 serves as an evaporator. An outdoor fan 23 controlled by the controller 18 moves outdoor air over the coil 22. The refrigerant fluid picks up heat from the outdoor air and then proceeds back to the suction port S of the compressor 12. An outdoor air temperature sensor 24 is disposed the air flow going through the outdoor coil 22, and provides the controller 18 with an input that represents the outdoor air temperature $T_o$.

Not shown in FIG. 1 are an indoor heat exchanger for providing an indoor comfort space with heating in cool weather or cooling and dehumidification in hot weather. Also omitted from this view is a four-way valve to control refrigerant fluid flow between the compressor 11, the not-shown indoor heat exchanger, and the outdoor heat exchanger 21.

When the outdoor air is employed as a heat source for water heating, the speed of the compressor 11 depends on the temperature $T_o$ of the outdoor air.

The controller 18 receives as inputs the water temperature $T_w$ from the water temperature sensor 17, the outdoor air temperature setting $T_o$ from the outdoor air temperature sensor 24, and a water temperature setpoint (i.e., the maximum water temperature) from the setpoint device 19.

A water heating cycle commences when the controller 18 detects that the sensed water temperature $T_w$ is some predetermined amount below the maximum temperature or limit established by the device 19. The controller IS starts the water pump 14, outdoor blower 23, and compressor 11 to heat water using the outdoor air as a heat source. The controller 18 controls the speed of the compressor 11 as a function of the outdoor air temperature $T_o$. This results in optimal system operation for water heating capacity and efficiency.

Figure 2:
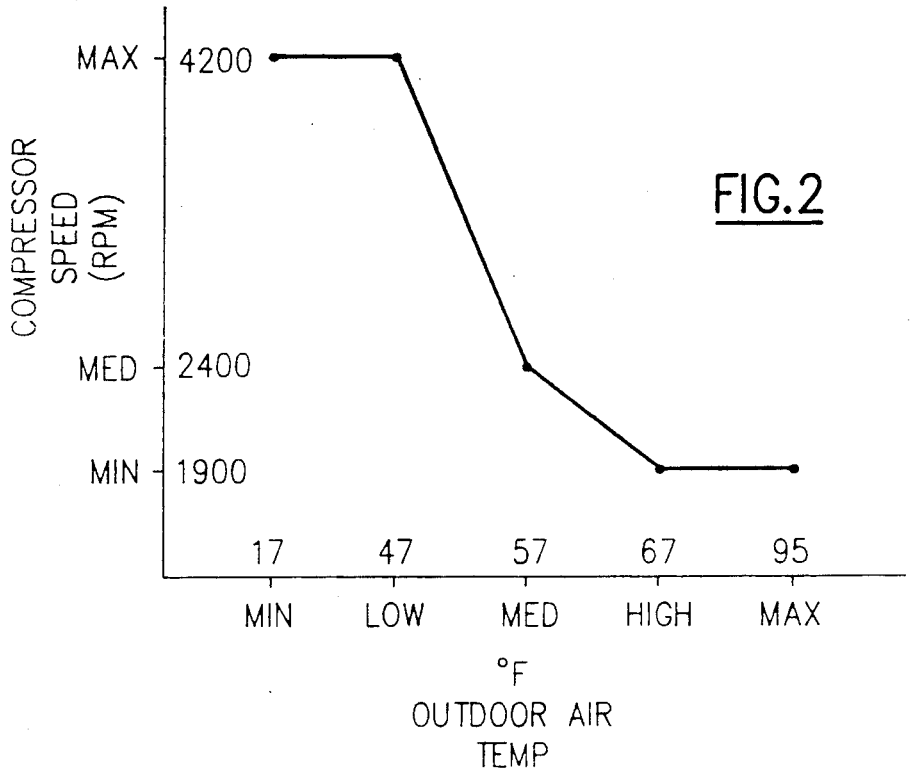
FIG. 2 is chart showing the relation of compressor speed to outdoor temperature for explaining the control process of this invention.

Compressor speed is regulated as a function of outdoor temperature generally as shown in the chart of FIG. 2. The compressor speed function here has four segments or parts, namely a flat part, at maximum compressor speed, for outdoor temperatures $T_o$ between a minimum temperature (e.g. 17 degrees F.) and a low temperature (e.g. 47 degrees F.); a first linear part where speed is reduced with increasing temperature, between the low temperature and an intermediate temperature (e.g. 57 degrees F.); a second linear part where speed is reduced with increasing temperature, between the intermediate temperature and a high temperature (e.g. 67 degrees F.) and another flat part, at minimum compressor speed, between the high temperature and a maximum outdoor temperature (e.g., 95 degrees F.). At outdoor temperatures below the minimum (here below 17 degrees F.) heat pump water heating is considered less cost efficient than other means, such as resistive heating. At outdoor temperatures exceeding the maximum temperature (e.g. above 95 degrees F.), the fluid pressure gradient in the compressor 11 becomes quite high, and the safe torque load limit can be exceeded. The two linear parts of the compressor speed function produce a substantially constant water heating output for temperatures between 47 degrees and 67 degrees. The two linear portions approximate the most efficient heat pump water heating operation over this range of outdoor temperatures.

The compressor operation is thus limited to outdoor temperature conditions between the minimum and maximum temperatures. The compressor is also operated only when the water temperature $T_w$ is below the maximum or limit water temperature as set by the setpoint device 19 which is limited to a predetermined maximum temperature reached at the maximum allowable compressor discharge pressure. Compressor operation is also limited to water temperature conditions where the temperature $T_w$ is above a minimum water temperature (e.g. 40 degrees F.). This is to ensure that liquid water is present in the tank 13 and is free of ice. Almost all practical systems would be expected to maintain the water temperature well above this minimum, except perhaps after having been shut down for some extended periods with the water tank located in cold environment.

For systems of this type, the minimum outdoor temperature can be on the order of 17° to 20° F., and the maximum outdoor temperature can be on the order of 90° to 97° F. Here, the compressor speed is at maximum or minimum for a range of about 20° F. above the minimum outdoor temperature and about 20° F. below the maximum outdoor temperature. This may vary somewhat from one system to the next.

Figure 3:
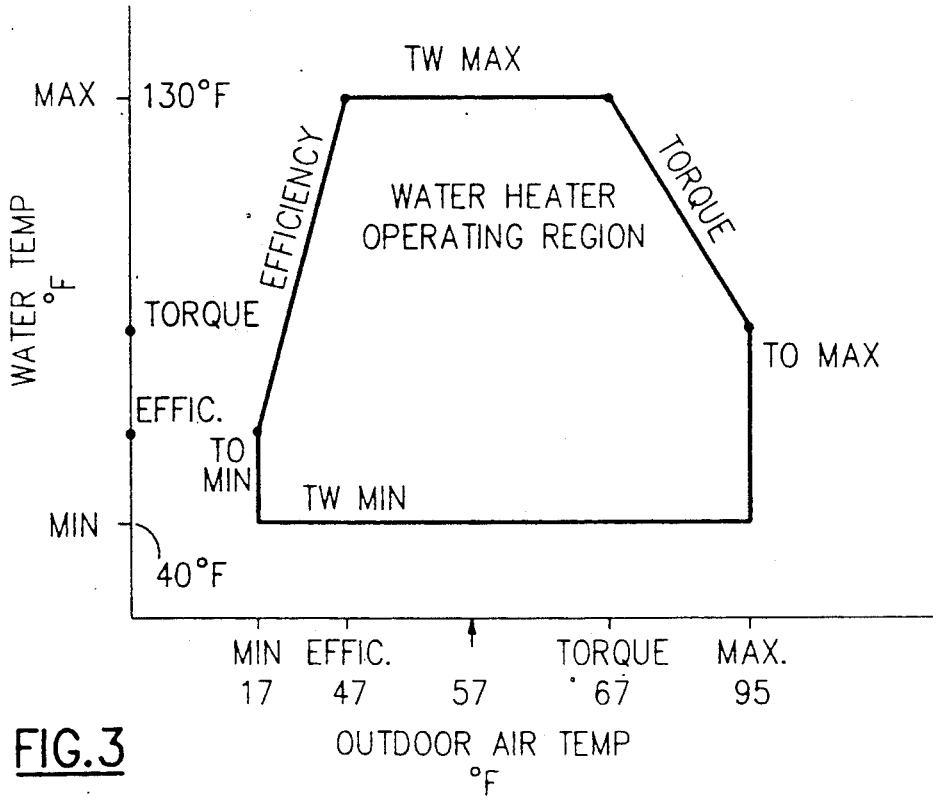
FIG. 3 is a chart showing a predetermined performance envelope in a field of outdoor temperatures and water temperatures for explaining the control process of this invention.

A field of permissible water temperatures $T_w$ and outdoor air temperatures $T_o$ can be predetermined for a given system, as shown for example in the chart in FIG. 3. The temperature $T_w$ and $T_o$ are shown on the ordinate and abscissa, respectively. The controller 18 limits water heating operations to conditions wherein both temperatures $T_w$ and $T_o$ are within a performance envelope, which is a six-sided figure in this example. The maximum water temperature is determined by the user on the setpoint device 19 which is limited to a predetermined maximum temperature reached at the maximum allowable compressor discharge and the minimum is some temperature above the freezing point, such as 40 degrees F. Right and left limits to the performance envelope are the maximum and minimum outdoor temperatures mentioned previously.

For low outdoor temperatures above the minimum there is a efficiency floor; here, and the performance envelope has a sloping side that connects the left (minimum outdoor temperature) side and the top (maximum water temperature). This side has a linear slope. For water heating when the outdoor temperature is rather low, the heat pump system heats the water only until the water temperature is reached that corresponds to the efficiency floor for that outdoor temperature. The resistive heating element 15 can be used to raise the water temperature to the desired temperature.

For high outdoor temperatures approaching the maximum temperature, the performance envelope has a torque ceiling that joins the top side (maximum water temperature) and the right side (maximum outdoor temperature). This is a linear slope, and signifies that when the outdoor temperature is high, the pressure of the refrigerant fluid in the system can impose an excessive torsional load on the compressor 11 if the water temperature is also high. Here, the heat pump system heats the water until the water temperature reaches the torque ceiling limit. Other heating means, such as the resistive element 15, continue the water heating to the setpoint.

For most conditions, the water heater relay 16 is disabled. A proportional-integral control algorithm in the controller 18 is implemented to ascertain whether the water heater element 15 should be energized. This permits the heat pump system to provide most of the water heating at high efficiency. The electric heater element or elements 15 in the water tank are employed only when the heat pump system cannot keep up with the water heating load and user comfort would be affected, or when resistive heating would be a more efficient means of water heating.

While the invention has been described in detail with reference to an illustrative embodiment, many modifications and variations would present themselves to those skilled in the art without departing from the scope and spirit of this invention as defined in the appended claims.

What is claimed is:

1. A process of controlling an integrated heat pump system of the type comprising a variable speed compressor having a discharge port and a suction port; a water heat exchanger coupled to the discharge port of said compressor for heating water by transfer of heat from a compressed heat exchange fluid; an outdoor evaporator heat exchanger having an outdoor fan and a coil receiving the heat exchange fluid from said water heat exchanger and coupled also to the suction port of the compressor, for drawing heat from the outdoor air which heat is transferred to the water in the water heat exchanger; a controller having output channels to control an outdoor fan and the speed of said variable speed compressor and inputs respectively coupled to a water heater setpoint adjustment means, an outdoor air temperature sensor for sensing the outdoor temperature of said outdoor air; and a water temperature sensor for sensing the temperature of the water heated by said water heat exchanger; the process comprising the steps of sensing the outdoor temperature $T_o$; sensing the water temperature $T_w$; controlling the speed of said compressor to operate at a lower speed when said outdoor temperature is high and at a higher speed when said outdoor temperature is low, within a range of outdoor temperatures from a minimum temperature to a maximum temperature; wherein said compressor speed is controlled substantially at a minimum speed for outdoor temperatures between a maximum outdoor temperature and a high temperature below said maximum outdoor temperature; substantially at a maximum speed for outdoor temperatures between a minimum outdoor temperature; and a low temperature above said minimum outdoor temperature, and at a variable speed that rises with decrease in outdoor temperature from said low temperature to said high temperature.

2. The process of claim 1 wherein said compressor speed is controlled in accordance with a compressor speed function relative to said outdoor temperature $T_o$, said compressor speed function having a first portion for outdoor temperatures from said minimum temperature to said low temperature over which said compressor is run substantially at a maximum speed, a second portion for outdoor temperatures from said low temperature to an intermediate temperature in which said compressor is run at speeds that decrease linearly with the outdoor temperatures at a first slope factor, a third portion for outdoor temperatures from said intermediate temperature to said high temperature in which said compressor is run at speeds that decrease linearly with the outdoor temperature at a second slope factor, and a fourth portion for outdoor temperatures between said high temperature and said maximum temperature over which said compressor is run substantially at a minimum speed.

3. The process of claim 2 wherein said minimum and maximum outdoor temperatures are on the order of 17° F. to 20° F. and 90° F. to 97° F., respectively.

4. The process of claim 3 wherein said low temperature is about 20° F. above said minimum temperature and said high temperature is about 20° F. below said maximum temperature.

5. A process of controlling an integrated heat pump system of the type comprising a variable speed compressor having a discharge port and a suction port; a water heat exchanger coupled to the discharge port of said compressor for heating water by transfer of heat from a compressed heat exchange fluid; an outdoor evaporator heat exchanger having an outdoor fan and a coil receiving the heat exchange fluid from said water heat exchanger and coupled also to the suction port of the compressor, for drawing heat from the outside air which heat is transferred to the water in the water heat exchanger; a controller having output channels to control the outdoor fan and the speed of said variable speed compressor and inputs respectively coupled to a water heater setpoint adjustment means, an outdoor air temperature sensor for sensing the temperature of said outside air and a water temperature sensor for sensing the temperature of the water heated by said water heat exchanger; the process comprising the steps of sensing the outdoor temperature $T_o$, sensing the water temperature $T_w$; and limiting the operation of the compressor to a field of temperatures between a minimum outdoor temperature and a maximum outdoor temperature, and between a minimum water temperature that is at least slightly greater than the freezing point of water and a maximum water temperature as established by said setpoint adjustment means, which is limited to a predetermined maximum temperature reached at the maximum allowable compressor discharge pressure.

6. The process of claim 5 wherein the step of limiting the operation of the compressor to said field of temperatures includes limiting the compressor operation, for corresponding outdoor temperatures $T_o$, to water temperatures $T_w$ at or below temperatures $T_E$ calculated from a compressor efficiency floor relationship in which the temperature $T_E$ increase with increasing outdoor temperatures for at least some outdoor temperatures between said minimum and maximum outdoor temperatures and for at least the corresponding water temperatures between said minimum and maximum water temperatures.

7. The process of claim 5 wherein the step of limiting the operation of the compressor to said field of temperatures includes limiting the compressor operation, for corresponding outdoor temperature $T_o$, to water temperatures $T_w$ at or below temperatures $T_T$ calculated from a compressor torque ceiling relation in which the temperatures $T_T$ decrease with increasing outdoor temperatures for at least some outdoor temperatures and for at least the corresponding water temperatures between said minimum and maximum water temperatures.

8. The process of claim 5 wherein said limiting the operation of the compressor includes limiting the compressor operation to outdoor temperatures $T_o$ and corresponding water temperatures $T_w$ within a six-sided temperature performance envelope of water temperature and outdoor temperatures, having lower and upper edges defined by said minimum and maximum water temperatures, an efficiency floor sloping edge joining said left edge to said upper edge and a torque ceiling sloping edge joining said right edge to said upper edge.

* * * * *